US005474338A

United States Patent [19]

Büscher

[11] Patent Number: 5,474,338

[45] Date of Patent: Dec. 12, 1995

[54] POWER-ACTUATED MOTOR-VEHICLE DOOR LATCH WITH ANTITHEFT MODE

[75] Inventor: Hans-Joachim Büscher, Düsseldorf, Germany

[73] Assignee: Kiekert GmbH & Co. KG, Heiligenhaus, Germany

[21] Appl. No.: 297,685

[22] Filed: Aug. 29, 1994

[30] Foreign Application Priority Data

Oct. 9, 1993 [DE] Germany ..... 43 34 522.0

[51] Int. Cl.[6] ..... E05C 3/06

[52] U.S. Cl. ..... 292/201; 292/199; 292/DIG. 27

[58] Field of Search ..... 292/201, 336.3, 292/DIG. 23, DIG. 26, DIG. 27, 199

[56] References Cited

U.S. PATENT DOCUMENTS

| | | | |
|---|---|---|---|
| 4,223,927 | 9/1980 | Kobayashi et al. | 292/336.3 |
| 4,573,723 | 3/1986 | Morita et al. | 292/336.3 |
| 4,974,886 | 12/1990 | Kleefeldt . | |
| 4,978,154 | 12/1990 | Kleefeldt . | |
| 5,149,159 | 9/1992 | Kleefeldt . | |
| 5,261,711 | 11/1993 | Mizuki et al. | 292/201 |
| 5,409,277 | 4/1995 | Rogers, Jr. et al. | 292/336.3 |

FOREIGN PATENT DOCUMENTS

| | | | |
|---|---|---|---|
| 4307523 | 9/1994 | Germany . | |
| 1514532 | 6/1978 | United Kingdom | 292/336.3 |

*Primary Examiner*—Peter M. Cuomo
*Assistant Examiner*—Gary Estremsky
*Attorney, Agent, or Firm*—Herbert Dubno; Andrew Wilford

[57] ABSTRACT

A motor-vehicle door latch has a latching element movable between a latched position and an unlatched position, and a locking pawl engageable with the element and displaceable between a locked position retaining it in the latched position and an unlocked position allowing it to move into the unlatched position. Power actuation is effected by a planetary-gear drive and including a reversible electric motor, a sun gear rotatable by the motor about the planetary axis, at least one planet gear meshing with the sun gear, a planet carrier carrying the planet gear, and a ring gear meshing with the planet gear. A locking lever is displaceable by a door handle and by the planet carrier between a locked position and an unlocked position and a coupling element is displaceable in the housing between a coupling position engaged between the locking pawl and locking lever for coupling the locking pawl and lever together for joint movement from the unlocked to the locked position and a decoupling position permitting the locking lever to move between its position without moving the locking pawl. An antitheft element is displaceable by the sun gear between an antitheft-on position engageable with the coupling element and retaining same in the decoupling position and an antitheft-off position permitting the coupling element to move between its positions. Structure coupled to the antitheft element arrests the planet carrier in the antitheft-on position of the antitheft element.

5 Claims, 9 Drawing Sheets

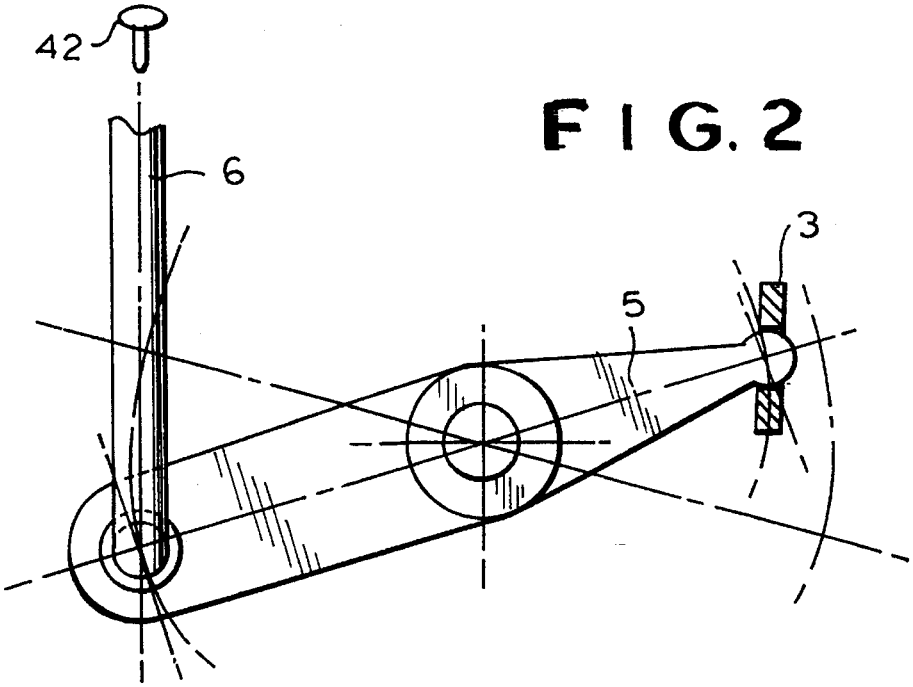
FIG. 2
FIG. 3
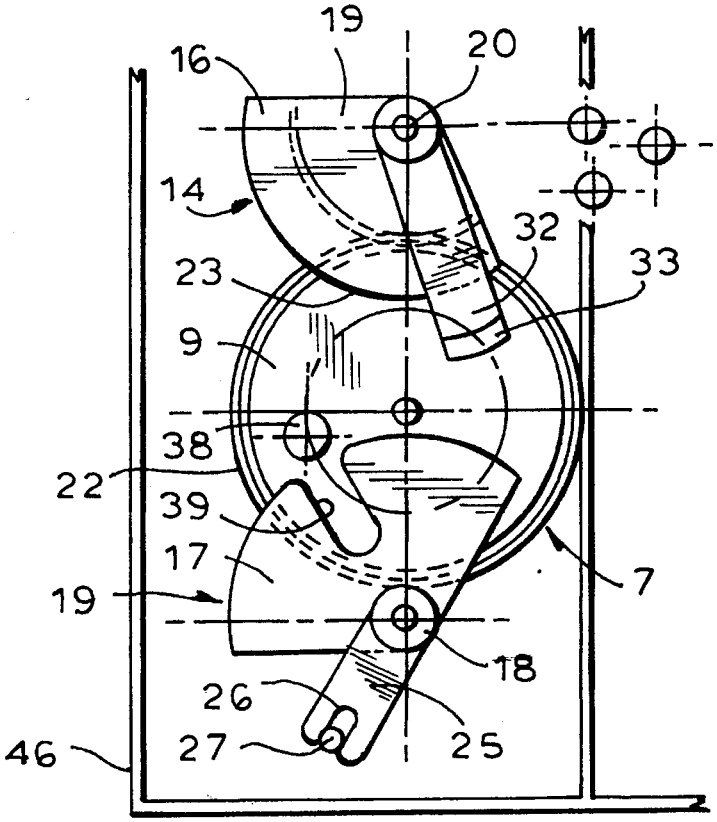

POWER-ACTUATED MOTOR-VEHICLE DOOR LATCH WITH ANTITHEFT MODE

SPECIFICATION

Field of the Invention

The present invention relates to a motor-vehicle door latch. More particularly this invention concerns such a door latch which can be remotely power actuated between the locked and unlocked position.

Background of the Invention

A standard motor-vehicle door latch such as described in U.S. Pat. Nos. 4,974,886 or 4,978,154 for use on a vehicle door having inside and outside handles and inside and outside locking elements has a housing, a latch fork pivotal on the housing and engageable in a locking position with a door bolt to retain same and lock the door, inside and outside operating levers pivoted on the housing and connected to the respective handles, and inside and outside locking levers pivoted on the housing and connected to the respective locking elements. An actuating lever operatively engageable with the fork can release same from the locking position and a link coupled to the locking levers is displaceable thereby between a position coupling the outside operating lever to the actuating lever for displacement of the fork out of the locking position by actuation of the outside operating lever and a position decoupling the outside operating lever from the actuating lever. Thus in the decoupling position actuation of the outside operating lever will not unlock the door. A central actuating unit has a motor whose spindle carries a nut that can move an antitheft lever into an antitheft position. Mechanism connected between the antitheft lever, the inside levers, and the link decouples the inside levers from the actuating lever in the antitheft position of the antitheft lever. Thus in the antitheft position actuation of the inside levers will not be able to release the fork.

U.S. Pat. No. 5,149,156 described an actuator for such a latch which has a housing adjacent the lock, a reversible electric motor in the housing having an output shaft extending along a motor axis, and an input gear fixed on the output shaft and rotatable thereby about the motor axis. A threaded spindle extending in the housing along a spindle axis adjacent the motor axis carries an output gear and a nut threaded on the spindle is movable along the spindle axis on rotation of the spindle between a pair of axially offset positions. A link connected between the nut and the lock can move the lock between its locked and unlocked positions on displacement of the nut between its end positions. A manual actuator, for instance an inside door-lock button, is coupled to the nut for manually displacing the nut between its end positions. A rocker pivotal about the shaft axis at the input gear carries a pair of connecting gears flanking and meshing with the input gear. This rocker is pivotal between angled positions in each of which a respective one of the connecting gears meshes with the output gear and through a central position with neither of the connecting gears meshing with the output gear. A spring urges the rocker into the central position so that torque transmitted to the rocker on rotation of the input gear pivots the rocker depending on input-gear rotation direction into one of its angled positions to couple the input gear to the output gear. Such an arrangement does not have, however, an antitheft mode.

In application Ser. No. 08/179,968 filed 11 Jan. 1994 by H. Brackmann et al the door latch has inside and outside locking elements and an actuator having an electric motor having a threaded output spindle and a drive nut threaded directly on the spindle and displaceable by the motor between unlocked, locked, and antitheft positions. An inside lever assembly includes a first inside lever pivoted on the housing and connected directly to the inside locking element for displacement jointly with the inside locking element between locked and unlocked positions and a second inside lever pivoted on the first inside lever and coupled to the actuator drive nut for pivotal displacement jointly therewith between unlocked, locked, and antitheft positions. A spring braced between the first and second levers urges abutments on them into engagement with each other so that when the abutments are spaced apart the spring is loaded. Coupling mechanism in the housing connected between the first inside lever, door handles, an outside locking element, the actuator nut, and a fork-release pawl couples the release pawl to the handles in the unlocked positions of the locking elements and actuator nut for operation of the release pawl by the handles. This mechanism decouples at least the outside handle from the release pawl in the locked position of either of the locking elements or of the actuator nut and decouples the first lever and both handles from the release pawl in the antitheft position of the actuator nut. The disadvantage of this system is that the motor for the power actuator must be moved for manual actuation of the latch.

Objects of the Invention

It is therefore an object of the present invention to provide an improved power-actuated antitheft-lock system.

Another object is the provision of such an improved power-actuated antitheft-lock system which overcomes the above-given disadvantages, that is which can be manually actuated without having to reverse-drive the actuator motor, in other words with easy manual actuation in spite of the possibility of power actuation.

Summary of the Invention

A motor-vehicle door latch according to the invention has a housing, a latching element movable in the housing between a latched position retaining a door bolt and an unlatched position releasing the door bolt, and a locking pawl engageable in the housing with the element and displaceable between a locked position retaining the latching element in the latched position and an unlocked position allowing the latching element to move into the unlatched position. Power actuation is effected by a planetary-gear drive in the housing centered on an axis and including a reversible electric motor, a sun gear rotatable by the motor about the axis, at least one planet gear meshing with the sun gear and orbitable about the axis, a planet carrier rotatable about the axis and carrying the planet gear, and a ring gear meshing with the planet gear and rotatable about the axis. A locking lever is displaceable in the housing by a door handle and by the planet carrier between a locked position and an unlocked position and a coupling element is displaceable in the housing between a coupling position engaged between the locking pawl and locking lever for coupling the locking pawl and lever together for joint movement from the unlocked to the locked position and a decoupling position permitting the locking lever to move between its position without moving the locking pawl. An antitheft element is displaceable in the housing by the sun gear between an antitheft-on position engageable with the coupling element and retaining same in the decoupling position and an antitheft-off position permitting the coupling element to move between its positions. Structure in the housing coupled to the antitheft element arrests the planet carrier in the antitheft-on position of the antitheft element.

Thus with this system it is possible to mechanically actuate the latch when it is in the locked or unlocked position without affecting the planetary gear drive. Thus such manual actuation is fairly simple and easy.

According to this invention the latch has a plate pivotal about a plate axis parallel to the planetary axis, formed with a slot open radially of the plate axis, and coupled to the locking lever. A pin on the planet carrier is engageable in the slot so that the planet carrier is coupled to the locking element via the pin and plate. This pin can pull wholly out of the slot to completely decouple the locking element from it.

The coupling structure according to the invention includes a sector gear rotatable about a sector-gear axis, meshing with the ring gear, and carrying the antitheft element, and having a lobe projecting radially of the sector-gear axis. The planet gear is formed with a recess complementary to the lobe which is engageable in the recess to arrest the planet carrier when the antitheft element and sector gear are in the antitheft position. The housing is provided with abutment operatively engaged by the antitheft element and locking lever in the locked, unlocked, antitheft-on, and antitheft-off positions.

BRIEF DESCRIPTION OF THE DRAWING

The above and other objects, features, and advantages will become more readily apparent from the following description, reference being made to the accompanying drawing in which:

FIG. 2 is a large-scale view of a detail taken along section line II—II of FIG. 1;

FIG. 3 is a vertical section corresponding to a detail of FIG. 1 but along a different plane and showing the system in the unlocked and antitheft-off positions;

SPECIFIC DESCRIPTION

Figure 1:
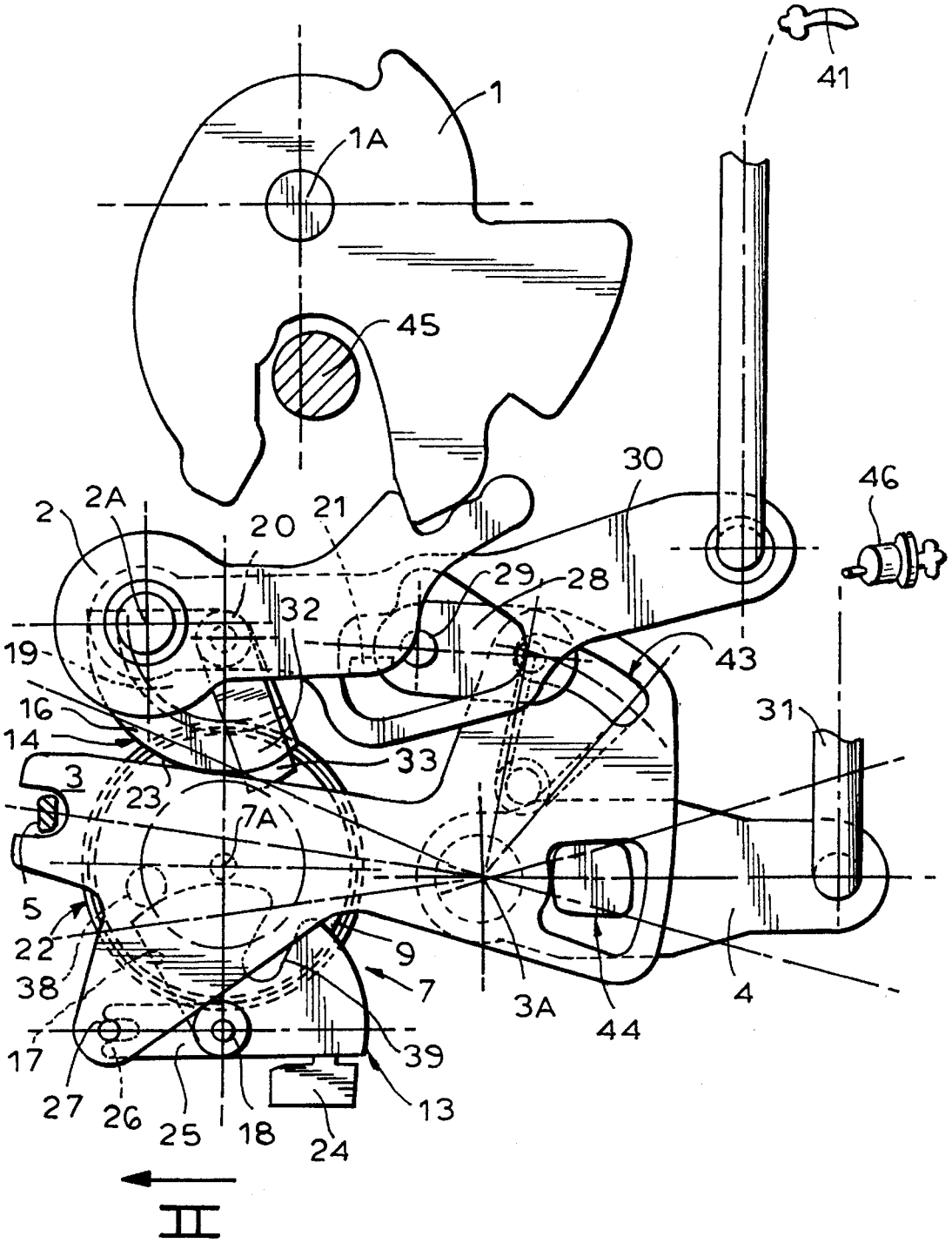
FIG. 1 is a side partly sectional view of the latch according to the invention in the locked and antitheft-off positions.

As seen in FIG. 1 a motor-vehicle door latch according to the invention has a bolt 45 that is mounted on a door post and that can be captured by a latch fork 1 pivoted at 1A on a latch housing 46 on the edge of a door and retainable in the illustrated latched position by a conventional latch pawl 2 in the manner well known in the art. Pivoting of the pawl 2 about its axis 2A clockwise will free the fork 1 to unlatch the door and allow it to be opened. An actuating lever 30 secured on the same pivot as the pawl 2 can be operated by an inside or outside door handle, such as illustrated at 41, to operate the latch. A coupling pin 29 described in more detail below can engage in an unlocked position of the door between a stepped edge of the lever 30 and a tab 21 on the pawl 2 so that clockwise pivoting of the lever 30 is transmitted to the pawl 2 to unlatch the door. When the pin 29 is pulled rightward as seen in FIG. 1 into an unlocked position where it no longer couples the lever 30 and pawl 2 together, downward pivoting of the actuating lever 30 will not unlatch the door. This structure is all generally standard.

A main locking lever 3 pivoted about an axis **3*a* parallel to the axes 1A and 2A carries via a lost-motion coupling 43 a link 28 carrying the pin 29. This lever 3 can be pivoted about its axis 3A by an outside locking lever 4 coupled to it via another lost-motion coupling 44. The lever 4 is connected via a rod 31 to an outside locking element, here a key cylinder 40. An inside locking element or button 42 shown in FIG. 2 is coupled via a rod 6 and a lever 5 to the main locking lever 3. Thus depression of the rod 6 by the button 42 or raising of the rod 31 by the cylinder 40 will pivot the main lever 3 counterclockwise from the position illustrated in FIG. 1 and put the pin 29 into position to couple the actuating lever 30 to the pawl 2, allowing the lever 30 to unlatch the door. Either of the locking elements 40 or 42 can, however, pivot the lever 3 clockwise into the illustrated locked position in which the coupling pin 29 decouples the lever 30 from the pawl 2**.

Figure 4:
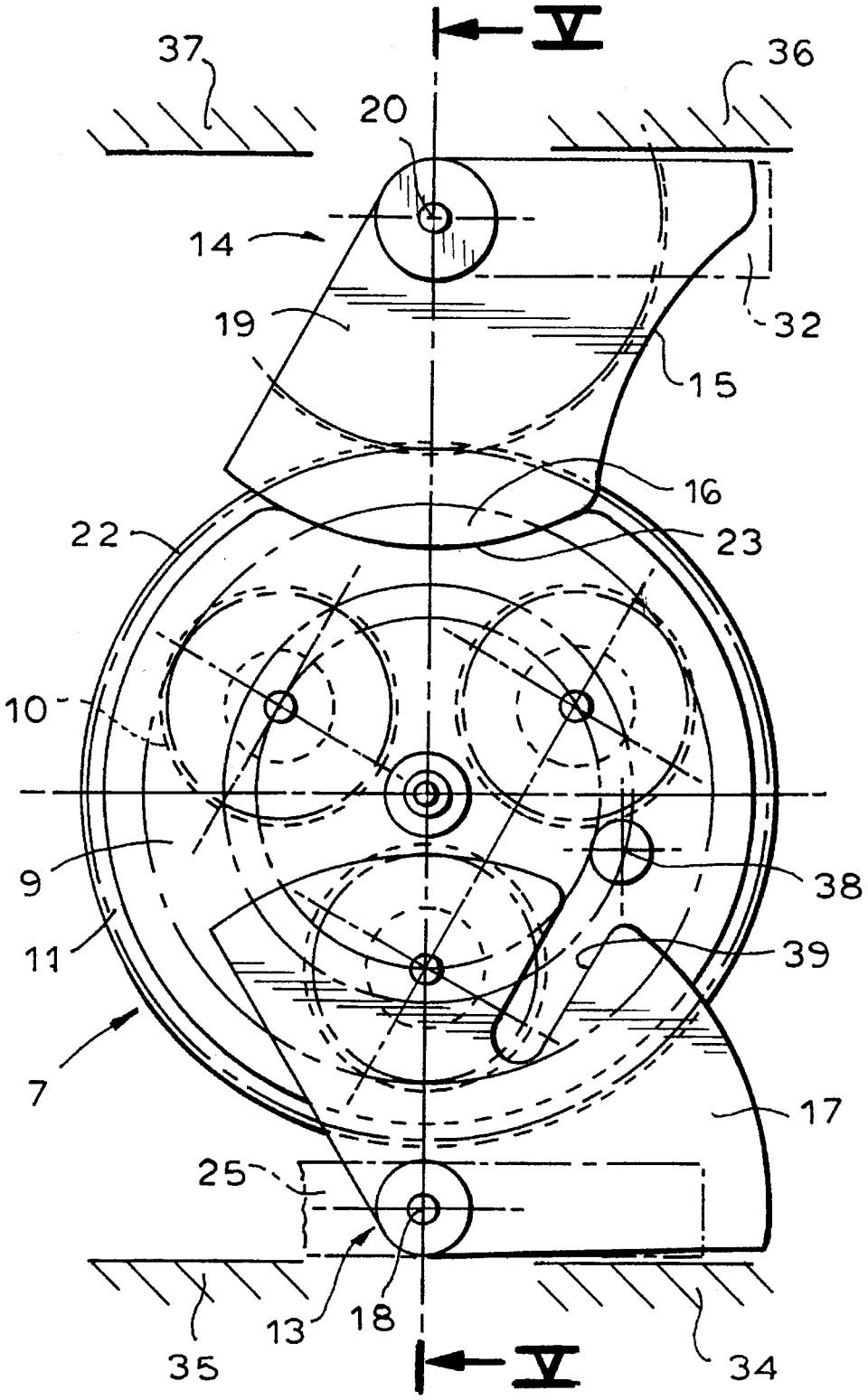
FIG. 4 is a partly diagrammatic large-scale view of a detail of FIG. 1 in the locked and antitheft-on positions.
Figure 5:
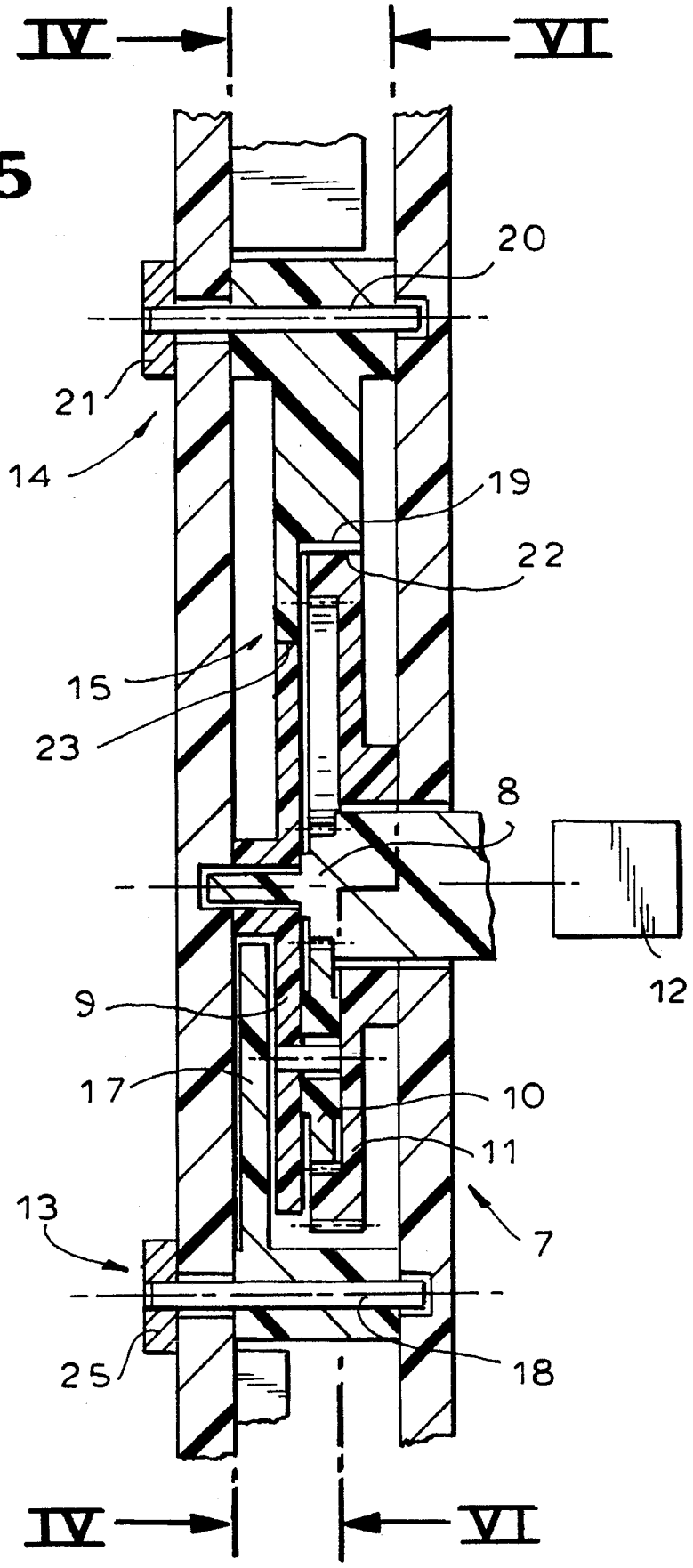
FIG. 5 is a section taken along line V—V of FIG. 4 with line IV—IV showing the section plane of FIG. 4.
Figure 6:
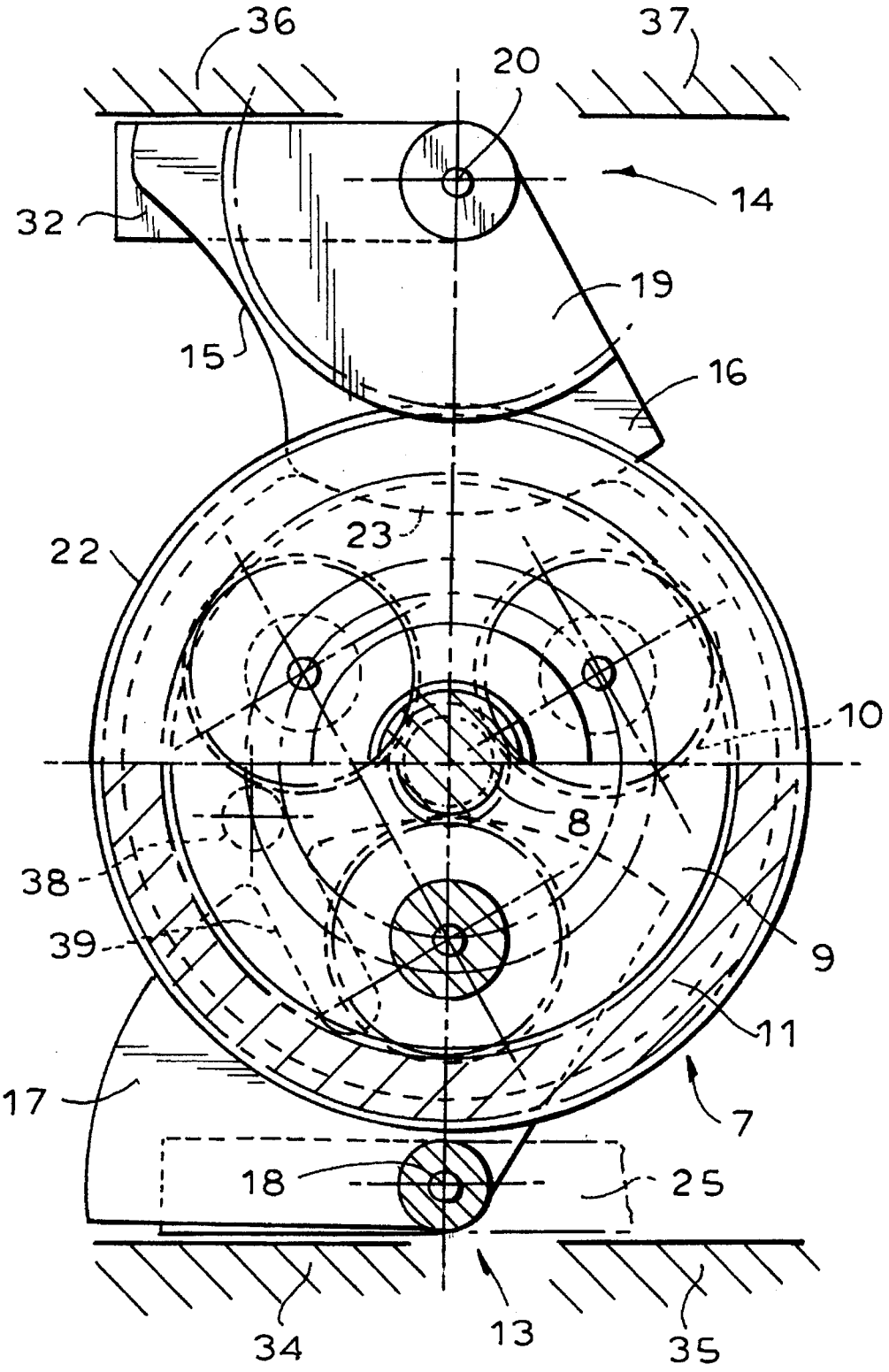
FIG. 6 is section taken along line VI—VI of FIG. 5, taken in the opposite direction as FIG. 4.

According to the invention a planetary-gear power actuator 7 is provided to switch between the above-described locked and unlocked positions, and also to set the latch in an antitheft position in which the latch cannot be unlocked even using the element 40 or 42. This actuator 7 has as best seen in FIGS. 4 through 6 a sun gear 8 meshing with three planet gears 10 supported on a rotatable planet carrier 9 and also meshing with another ring gear 11. The sun gear 8 is operated by a reversible electric motor 12. The planet carrier 9 can act on a locking assembly 13 mounted on a shaft 18 and an antitheft assembly 14 mounted on a shaft 20, both these shafts 18 and 20 being parallel to each other and to an axis 7A of the sun gear 8 and to the axes 1A, 2A, and 3A. The ring gear 11 can also act on the antitheft assembly 14 as described below.

The locking assembly 13 comprises a plate 17 fixed on the shaft 18 and formed with a radially open slot 39 that a pin 38 on the carrier 9 can engage in. This plate 17 can pivot through about 60° between a locked position (FIG. 4) engaging a fixed housing abutment 34 and an end switch 24 (FIG. 1) and a position engaging another fixed housing abutment 35. A lever or arm 25 fixed on the shaft 18 has a forked end 26 which engages over a pin 27 fixed on the lever 3. Thus as the plate 17 moves between its locked and unlocked positions it pivots the lever 3 synchronously between its locked and unlocked positions. As long as the pin 38 is not engaged in the slot 39, however, the lever 3 can move independently of the plate 17.

The antitheft assembly 14 comprises a sector gear or plate 19 fixed on the shaft 20 and meshing with teeth 22 on the outside of the ring gear 11. This sector gear 19 has a radially projecting part-circular tongue or part 16 whose outer edge has a center of curvature on the shaft 20 and which can engage in a complementary outwardly open part-circular cutout 23 formed on the planet carrier 9. The gear 19 is movable angularly between an antitheft-on position engaging a fixed housing abutment 36 (FIG. 4) and with its part 16 engaged in the cutout 23 and an antitheft-off position engaging a fixed housing abutment 37 and with a cutout 15 engaging over the edge of the planet carrier 9. When the part 16 engages in the cutout 23 the planet carrier 9 cannot rotate but when the carrier 9 fits into the cutout 15 it can rotate. The shaft 20 carries a lever or arm 32 having a bent over end 33 that in the antitheft-on position blocks leftward movement of the pin 29 into the coupling position, but in the antitheft-off position permits movement of the coupling pin 29 between its coupling and uncoupling positions.

The latch described above operates as follows:

In the starting position of FIG. 1 the plate 17 engages the abutment 34 and switch 24 so that it can no longer rotate clockwise. The carrier 9 and pin 38 are rotated fully counterclockwise so the pin 38 rests on the edge of the plate 17. If the motor 12 continues to rotate with the carrier 9 thus arrested, the ring gear 11 will be forced to rotate. This will pivot the antitheft plate 19 into the antitheft-on position whereupon further rotation will be possible and a timer will cut out the motor. In this antitheft position, as described above, the door is locked and cannot be unlocked, even using the unlock element 40 and 42.

From this position reverse rotation of the motor will, to start with rotate the sun gear 11 in the opposite direction, at first therefore moving the arm 32 from the antilock-on to the antilock-off position. In this latter position the tongue 16 has moved out of the cutout 23, freeing the carrier 9 to rotate so that it will turn, engaging the pin 38 in the slot 39 and moving the latch to the unlocked position and, in fact, pulling the pin 38 out of the slot 39 to permit manual actuation of the latch.

Figure 8:
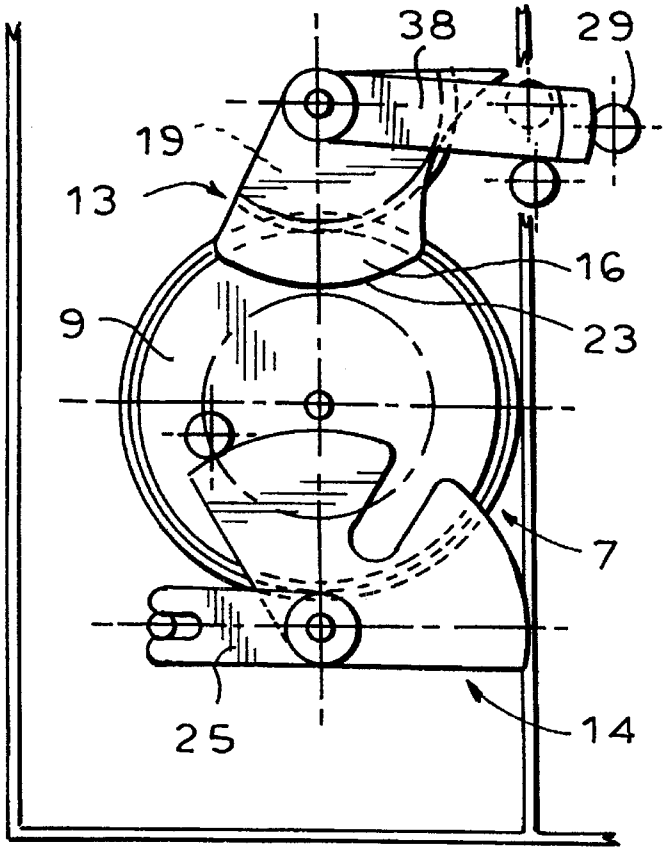
FIGS. 7 through 14 are views like FIG. 3 showing parts of the latch in different positions.
Figure 7:
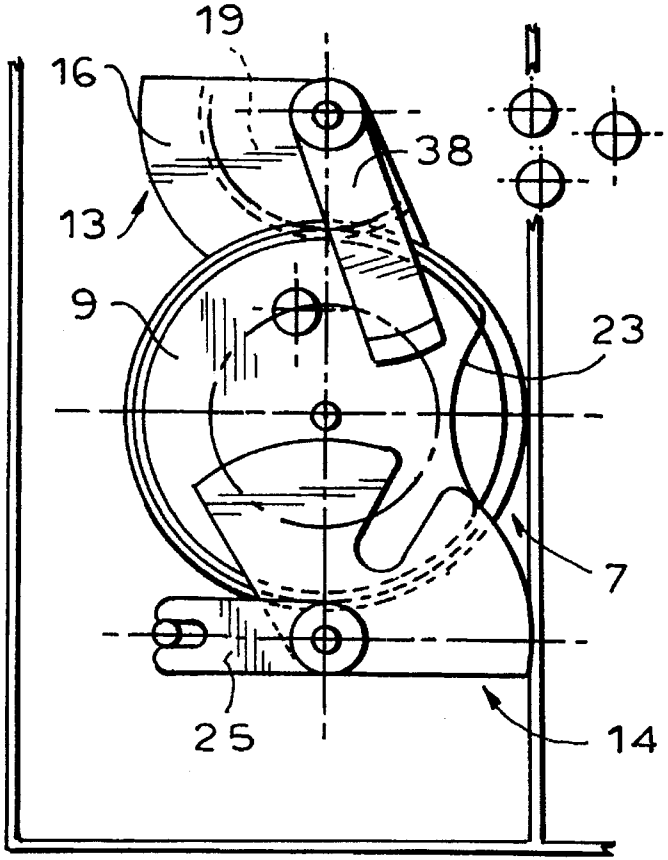
Figure 10:
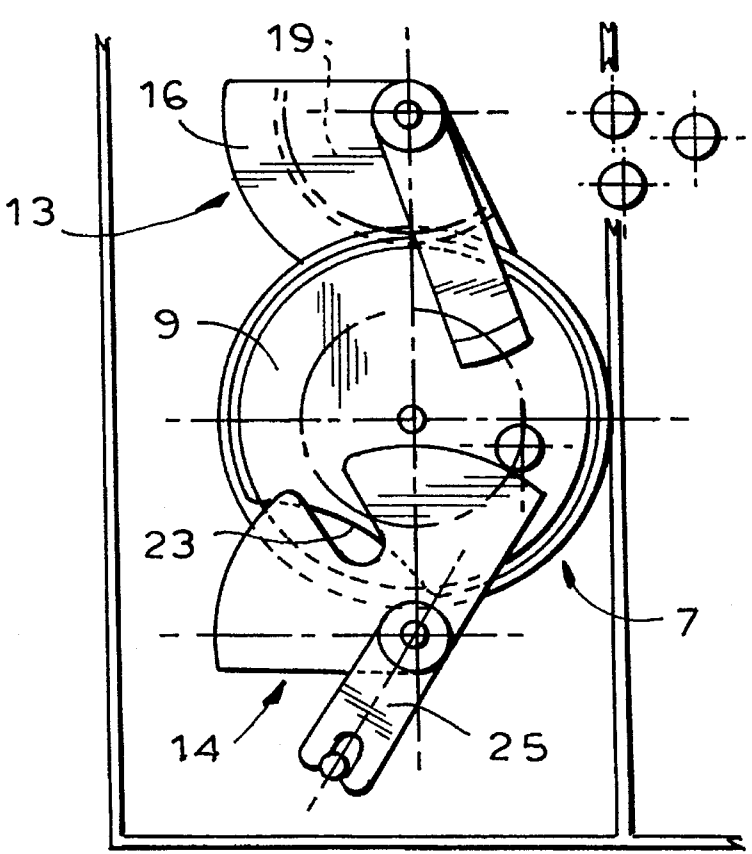
Figure 9:
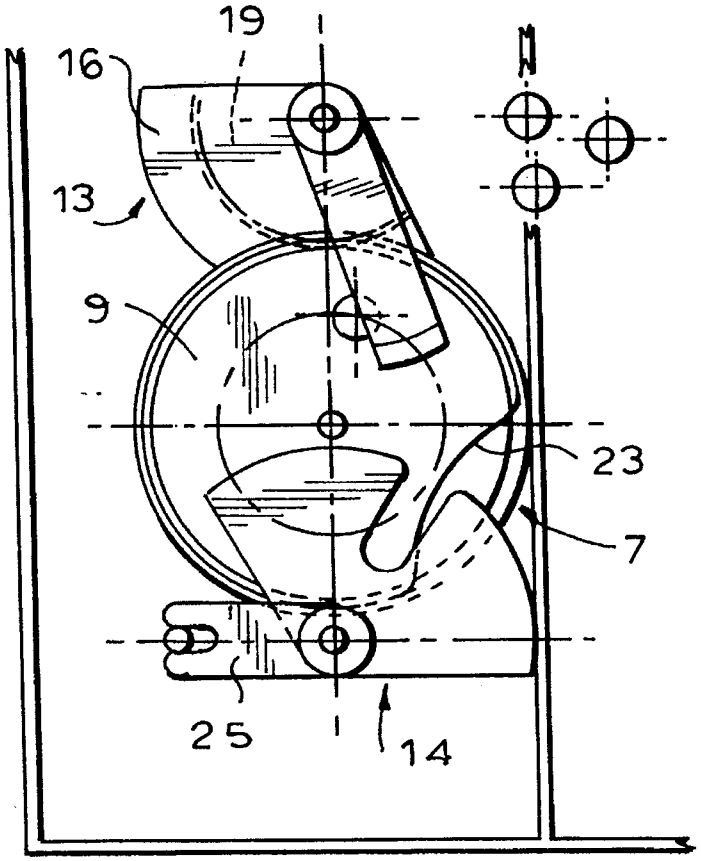

Of course during either operation the motor 12 can stop intermediately in the locked/antitheft-off position. In the locked and unlocked positions manual operation of the latch is permitted as shown in FIGS. 7 through 14. FIG. 7 shows the locked position set electrically from the antitheft position. FIG. 8 shows the antitheft-on position set electrically from the central locking system. In FIG. 9 one can See the locked position electrically set from the unlocked position. FIG. 10 shows the unlocked position electrically set by the central locking system.

Figure 12:
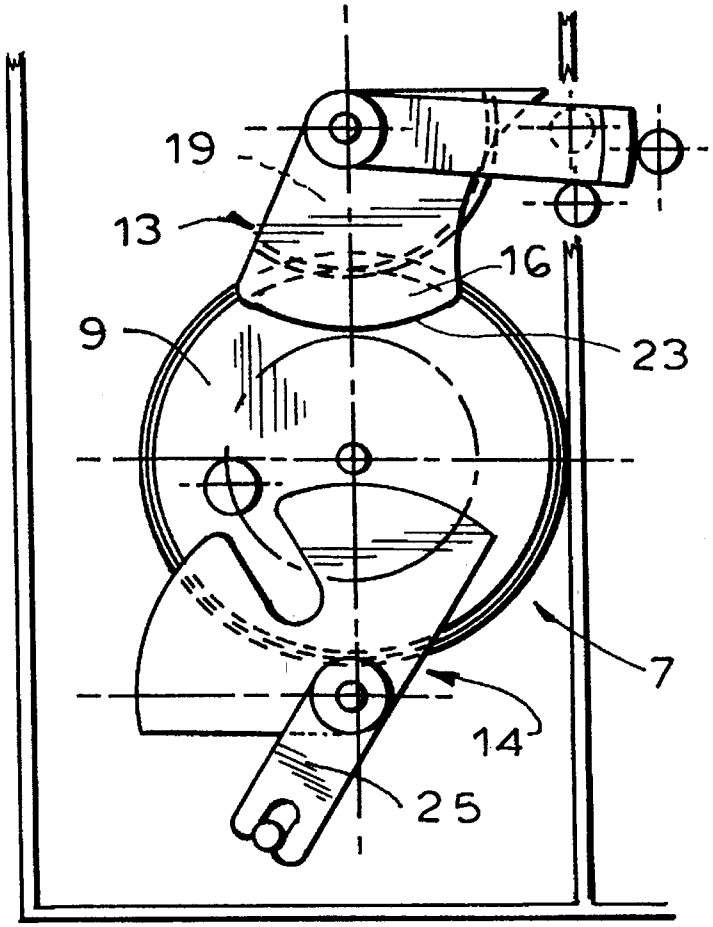
Figure 11:
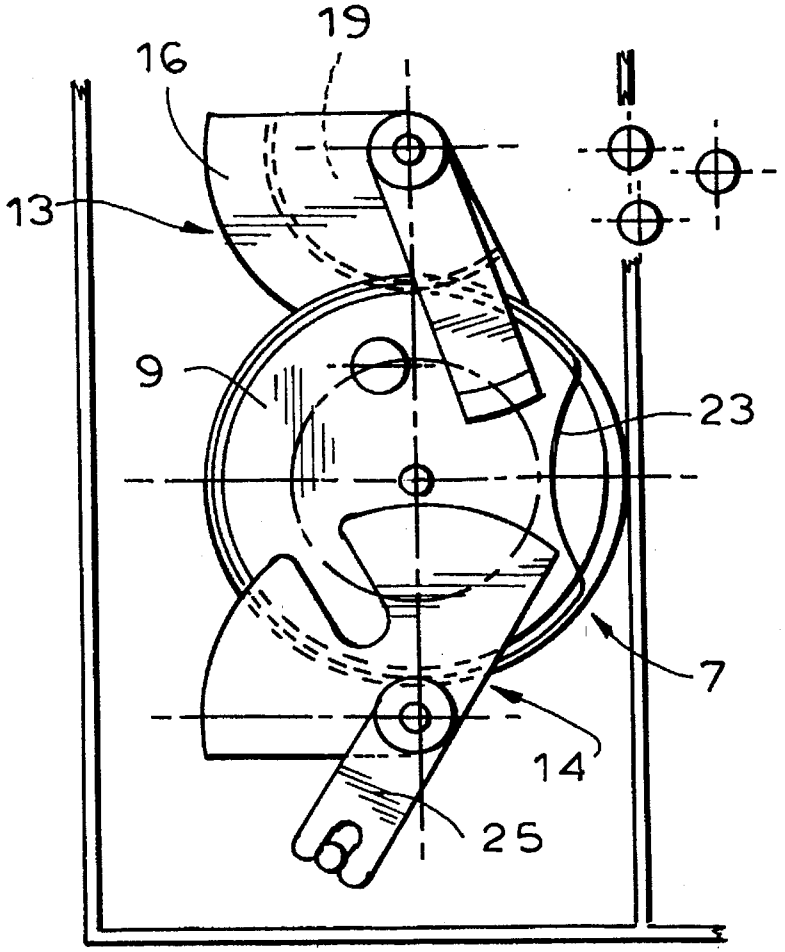
Figure 13:
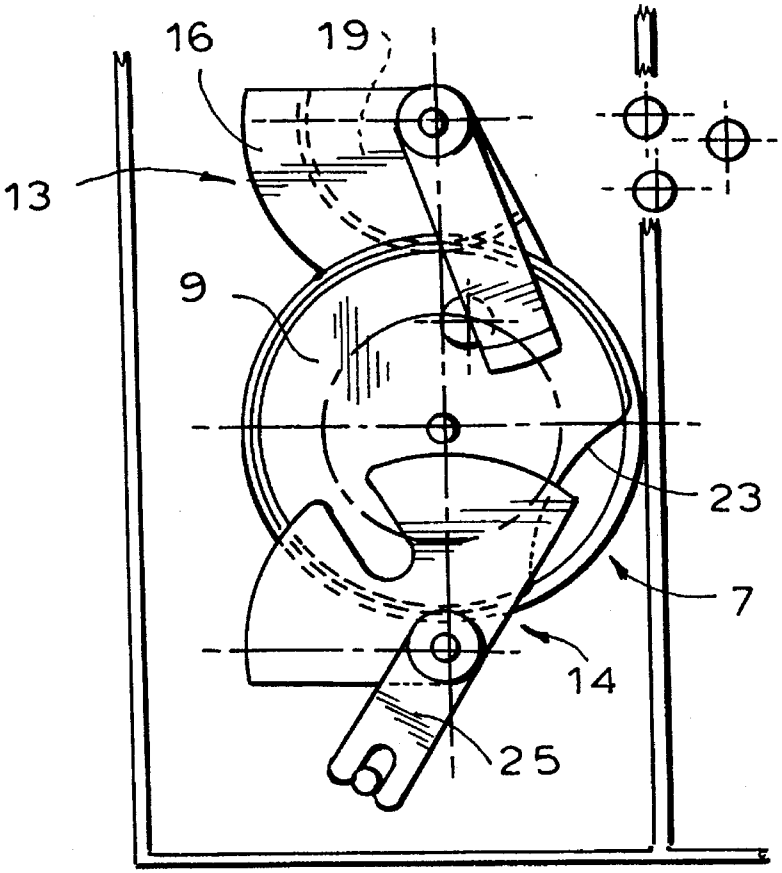
Figure 14:
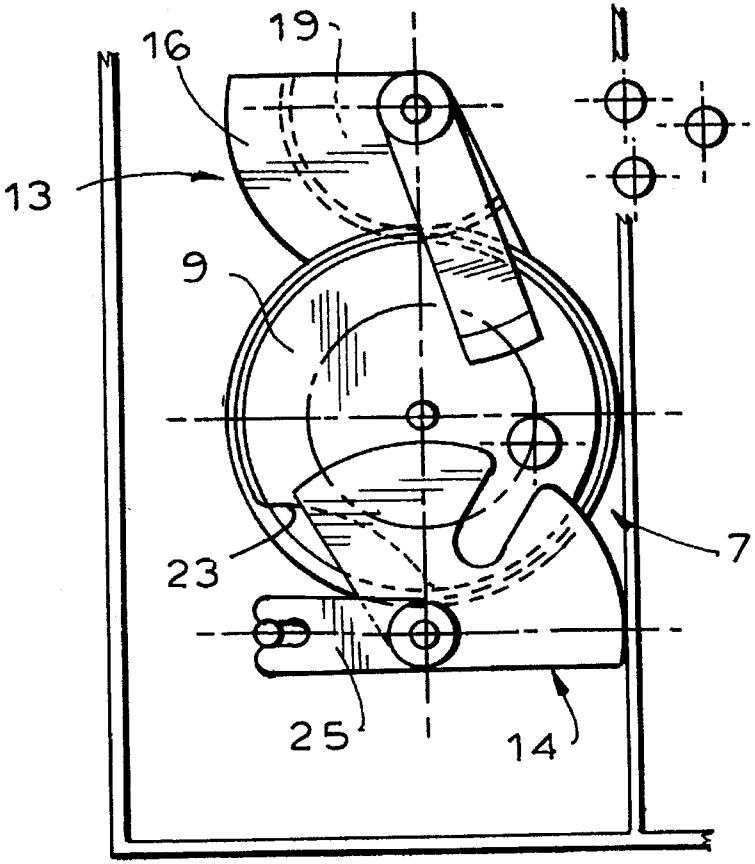

FIG. 11 shows the unlocked position that is reached manually through the lever 5. FIG. 12 shows the antitheft-on position set by the inside locking lever 5. FIG. 13 shows the unlocked position set by the lever 5. FIG. 14 shows the locked position set by the lever 5.

I claim:

1. A motor-vehicle door latch comprising:

a housing;

a latching element movable in the housing between a latched position retaining a door bolt and an unlatched position releasing the door bolt;

a locking pawl engageable in the housing with the element and displaceable between a locked position retaining the latching element in the latched position and an unlocked position allowing the latching element to move into the unlatched position;

a planetary-gear drive in the housing centered on an axis and including a reversible electric motor, a sun gear rotatable by the motor about the axis, at least one planet gear meshing with the sun gear and orbitable about the axis, a planet carrier rotatable about the axis and carrying the planet gear, and a ring gear meshing with the planet gear and rotatable about the axis;

a locking lever displaceable in the housing by a door handle and by the planet carrier between a locked position and an unlocked position;

means including a coupling element displaceable in the housing between a coupling position engaged between the locking pawl and locking lever for coupling the locking pawl and lever together for joint movement from the unlocked to the locked position and a decoupling position permitting the locking lever to move between its position without moving the locking pawl;

means including an antitheft element displaceable in the housing by the ring gear between an antitheft-on position engageable with the coupling element and retaining same in the decoupling position and an antitheft-off position permitting the coupling element to move between its positions; and means including structure in the housing coupled to the antitheft element for arresting the planet carrier in the anti-theft-on position of the antitheft element.

2. The motor-vehicle door latch defined in claim 1, further comprising a plate pivotal about a plate axis parallel to the planetary axis, formed with a slot open radially of the plate axis, and coupled to the locking lever; and a pin on the planet carrier engageable in the slot, whereby the planet carrier is coupled to the locking element via the pin and plate.

3. The motor-vehicle door latch defined in claim 1 wherein the structure includes:

a sector gear rotatable about a sector-gear axis, meshing with the ring gear, and carrying the antitheft element.

4. The motor-vehicle door latch defined in claim 3 wherein the sector gear further has a lobe projecting radially of the sector-gear axis, the structure further including a recess formed on the planet gear and complementary to the lobe, the lobe being engageable in the recess to arrest the planet carrier when the antitheft element and sector gear are in the antitheft position.

5. The motor-vehicle door latch defined in claim 1 wherein the housing is provided with abutment operatively engaged by the antitheft element and locking lever in the locked, unlocked, antitheft-on, and antitheft-off positions.

* * * * *